US005798581A

United States Patent [19]

Keagy et al.

[11] Patent Number: 5,798,581

[45] Date of Patent: Aug. 25, 1998

[54] LOCATION INDEPENDENT DIMMER SWITCH FOR USE IN MULTIPLE LOCATION SWITCH SYSTEM, AND SWITCH SYSTEM EMPLOYING SAME

[75] Inventors: Jon M. Keagy, North Wales; Donald R. Mosebrook, Bethlehem; Joel S. Spira, Coopersburg, all of Pa.

[73] Assignee: Lutron Electronics Co., Inc., Coopersburg, Pa.

[21] Appl. No.: 768,141

[22] Filed: Dec. 17, 1996

[51] Int. Cl.[6] ..... H05B 37/02

[52] U.S. Cl. ..... 307/115; 315/291

[58] Field of Search ..... 307/115, 140, 307/127; 361/82, 84; 323/324, 905; 315/291, DIG. 4, 307, 292–297

[56] References Cited

U.S. PATENT DOCUMENTS

| | | | |
|---|---|---|---|
| Re. 33,504 | 12/1990 | Yuhasz et al. | 307/115 |
| 4,649,323 | 3/1987 | Pearlman et al. | 315/307 |
| 4,689,547 | 8/1987 | Rowen et al. | 323/239 |
| 4,745,351 | 5/1988 | Rowen et al. | 323/239 |
| 4,833,339 | 5/1989 | Luchaco et al. | 307/115 |
| 5,005,211 | 4/1991 | Yuhasz | 455/603 |
| 5,099,193 | 3/1992 | Moseley et al. | 323/324 |
| 5,146,153 | 9/1992 | Luchaco et al. | 323/324 |
| 5,237,264 | 8/1993 | Moseley et al. | 323/324 |
| 5,248,919 | 9/1993 | Hanna et al. | 315/291 |
| 5,399,940 | 3/1995 | Hanna et al. | 315/129 |

OTHER PUBLICATIONS

Lutron® Wallbox Lighting Control Catalog, Second Edition, P/N 360–178, 1995, p. 26, and p. 60 (wiring diagram Nos. 10 and 11).

Lutron®, nova T☆® OMNISLIDE™ installation instructions, "Two–Location Incandescent Dimming System", P/N 030–247 Rev. 1, 1989, 4 pages.

Lutron®, nova OMNISLIDE™, "Incandescent Low Voltage Two–Location Slide Dimming System", P/N 030–195, 1987, 4 pages.

Lightolier® Controls, ONSET Designer Style Micro–Touch Digital Dimmer Installation and Operating Instructions, P/N 85–0236A, 8 pages.

Decora® Lighting Controls, Touch Dimmers and Canadian Touch Dimmers, p. 20.

Lutron®, Spacer™ Personal Space Light Control, 1996, Information includes P/N Nos. 360–486 (2 sheets), 362–899 (5 sheets), and 360–487 (3 sheets).

Lutron®, Symphony Series™ (a new standard for lighting controls), 1992, Information includes P/N Nos. 360–324 (2 sheets) and 360–326 (2 sheets).

Lutron®, nova T☆® Electronic Touch–Switch/Infrared Receiver (NTETS–1000–IR), 1989, 5 pages.

Lutron®, nova T☆® Electronic Touch–Switch/Infrared Receiver (NTETS–R–IR), 1989, 4 pages.

Lutron®, nova T☆® Switch hand™ Wireless Control (NTETS–IT), 1988, 1 page.

Lutron®, Lighting Controls, Condensed Catalog, 1990, pp. 12–13.

*Primary Examiner*—Richard T. Elms

*Attorney, Agent, or Firm*—Woodcock Washburn Kurtz Mackiewicz & Norris LLP

[57] ABSTRACT

A wall mountable dimmer switch for controlling the level of AC power delivered to a load, such as a lighting load. The switch is capable of being used as a single pole, three-way or four-way dimmer switch. The switch is responsive to signals supplied by auxiliary devices to increase, decrease or toggle on/off the power delivered to the load irrespective of the location of the switch when it is used in a multiple location switching system, and irrespective of the wiring of its hot and dimmed leads.

40 Claims, 8 Drawing Sheets

FIG.6
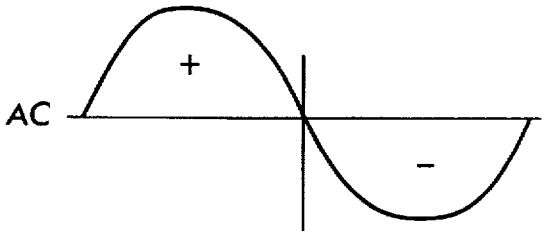
| AUXILIARY DEVICE | | | | | |
|---|---|---|---|---|---|
| OPERATION | SOURCE | OPT 1 | OPT 2 | OPT 1 | OPT 2 |
| TOGGLE (t) | REM S | L | H | L | H |
| TOGGLE (t) | REM L | L | L | L | L |
| RAISE (r) | REM S | L | H | H | L |
| RAISE (r) | REM L | H | L | L | L |
| LOWER (ℓ) | REM S | H | L | L | H |
| LOWER (ℓ) | REM L | L | L | H | L |
| NONE | — | H | L | H | L |
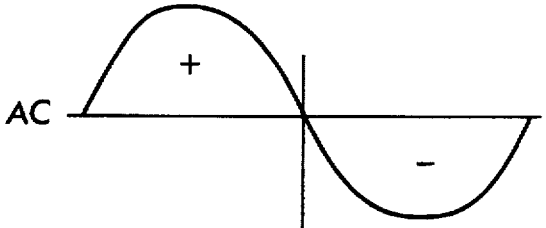
| AUXILIARY DEVICE | | | | | |
|---|---|---|---|---|---|
| OPERATION | SOURCE | OPT 1 | OPT 2 | OPT 1 | OPT 2 |
| TOGGLE (t) | REM S | * | L | * | L |
| TOGGLE (t) | REM L | L | * | L | * |
| RAISE (r) | REM S | * | L | * | H |
| RAISE (r) | REM L | H | * | L | * |
| LOWER (ℓ) | REM S | * | H | * | L |
| LOWER (ℓ) | REM L | L | * | H | * |
| NONE | — | H | H | H | H |
* = DON'T CARE
FIG.9

LOCATION INDEPENDENT DIMMER SWITCH FOR USE IN MULTIPLE LOCATION SWITCH SYSTEM, AND SWITCH SYSTEM EMPLOYING SAME

FIELD OF THE INVENTION

The present invention relates to a wall mountable dimmer switch that can be wired for use in any location of a multiple location switch system without regard to the arrangement of the system wiring to the dimmer switch. The present invention also relates to a multiple location switch system employing such a dimmer switch.

BACKGROUND OF THE INVENTION

Three-way and four-way switch systems for use in controlling loads in buildings, such as lighting loads, have long been known in the art. The switches used in these systems are wired to the building's AC wiring system and are subjected to AC source voltage and carry full load current, as opposed to low voltage switch systems that operate at low voltage and low current and communicate low voltage commands (usually low voltage DC logic levels) to a remote controller that controls the level of AC power delivered to the load in response to the commands. Thus, as used herein, the terms "three-way switch", "three-way system", "four-way switch" and "four-way system" mean such switches and systems that are subjected to the AC source voltage and carry the full load current.

In a three-way switch system, there are two three-way switches for controlling the load, e.g., one adjacent each passageway into the room, and each switch is fully operable to independently control the load irrespective of the status of the other switch. A four-way switch system is required when there are more than two switch locations from which to control the load. For example, a three switch system requires two three-way switches and one four-way switch, wired in well known fashion, so as to render each switch fully operable to independently control the load irrespective of the status of any other switch in the system. In the exemplary three switch system, the prior art requires the four-way switch to be wired between the two three-way switches in order for all switches to operate independently, i.e., one three-way switch must be wired at the AC source side of the system (sometimes called the "line" side), the other three-way switch must be wired at the load side of the system, and the four-way switch must be electrically situated between the two three-way switches. As another example, a four switch system requires two four-way switches and two three-way switches, wired in well known fashion, to render all switches fully operable to independently control the load. In this exemplary four switch system, the prior art requires one three-way switch to be wired at the line side of the system, the other three-way switch to be wired at the load side of the system, and the two four-way switches to be electrically situated between the two three-way switches. In the prior art four-way switch systems, the electrical location of the four-way switches is critical to maintain proper system operation; they must be electrically situated between the three-way switches, else system wiring changes may be necessary.

Three-way dimmer switches can be used in four-way switch applications, but the dimmer switch must, when used in conjunction with standard three-way and four-way switches, be wired into one of the locations where the three-way switch would normally be placed, i.e., at either the line side or the load side of the system. In the prior art, faulty operation of the switching system results if the dimmer switch is wired at one of the (intermediate) four-way switch locations. Another drawback is that the power level delivered to the load (dimming level) can only be adjusted at the location where the dimmer is situated.

Three-way and four-way dimming systems that employ a dimmer switch and one or more specially designed auxiliary (remote) switches that permit the dimming level to be adjusted from multiple locations have been developed, but they suffer from the same drawback as described above, i.e., the dimmer switch must be wired at either the line or load side of the system. Moreover, the pair of wires of the dimmer switch that are used to connect it to system wiring (and that also carry the load current—sometimes called the "hot" and "dimmed hot" lead wires), must be properly connected to the system wiring (i.e., with the hot lead wire connected to the line side of the system and the dimmed hot lead wire connected to the load side of the system); if the wiring of these wires is reversed, the dimming system may not operate properly.

Commonly assigned U.S. Pat. No. 5,248,919 (the 919 patent), incorporated herein by reference in its entirety, discloses a multiple location lighting control system, including a wall mountable dimmer switch and wall mountable remote switches for wiring at all (N) locations of a multiple location switch system. The dimmer switch and the remote switches, all of which are subjected to AC source voltage and carry full load current, each have intensity raise, intensity lower and toggle load on/off actuators, and the dimmer switch is responsive to actuation of any of these actuators to alter the dimming level (or power the load on/off) accordingly. In particular, actuation of an actuator at any of the remote switches causes an AC control signal or partially rectified AC control signal (having source voltage) to be communicated from that remote switch to the dimmer switch over one of the wires of the AC wiring interconnecting the various switch locations, and the dimmer switch is responsive to receipt of the control signal to alter the dimming level or toggle the load on/off. Thus, the load can be fully controlled from any of the N locations. A drawback of the system disclosed in the 919 patent is that the dimmer switch must be wired at the line side or load side of the switch system. Stated otherwise, if the switch location wired to the line side of the system is defined as the first switch location, and the switch location wired to the load side of the system is defined as the last, or Nth, switch location, then the dimmer switch cannot be wired at a switch location electrically intermediate the first and last switch locations.

The dimmer switch of the 919 patent employs a triac to control the dimming level, and a microprocessor controls the firing angle of the triac via the gate terminal. Each main terminal of the triac is coupled to a hookup wire of the dimmer switch, one through a choke (not shown); one hookup wire defines the hot lead of dimmer switch and the other hookup wire defines the dimmed hot lead of the dimmer switch. Thus, these two hookup wires are subjected to source voltage and carry full load current during system operation. The dimmer switch also has a third hookup wire, a control wire, that interconnects all of the switches in the system, and that carries the above mentioned control signals to the dimmer switch. The control wire does not carry full load current, but as mentioned, the signals are of the same voltage as the AC source. A conventional four-way wiring scheme may be employed to interconnect various switch locations, i.e., they may be interconnected by three conductor wire, such as type NM 14/3 or 12/3 wiring. Thus, the system of the 919 patent is particularly suited for use in an installation that has already been wired for a four-way switch system. However, one drawback of the dimmer switch of the 919 patent is that the dimmer switch will not respond to the actuation of the actuators on some, or possibly all, of the auxiliary switches if the hot and dimmed hot leads of the dimmer switch are reversed.

A commercial embodiment of the dimming system disclosed in the 919 patent is presently manufactured by the assignee hereof, Lutron Electronics Co., Inc., Coopersburg, Pa. ("Lutron"), under the trademark MAESTRO®. The MAESTRO® dimmer switch and remote switches function as above described, and also as further described in the 919 patent. The MAESTRO® system and components are more fully described in the Lutron publications entitled "LUTRON® Wallbox Lighting Catalog" (P/N 360-178); "Symphony Series™,—A New Standard for Lighting Controls—MAESTRO®—The Smart Dimmer . . . " (P/N 360-326); and "Introducing Lutron's Symphony Series™—A new Standard for Lighting Controls—MAESTRO®—The Smart Dimmer" (P/N 360/324), all of which are incorporated herein by reference. The MAESTRO® dimmer switch suffers from the same drawbacks discussed above in connection with the 919 patent. Thus, for example, in the MAESTRO®, where the hot lead wire of the dimmer switch is a black wire, and the dimmed hot lead wire of the dimmer switch is a red wire, the dimmer switch will not respond to actuation of the actuators on the remote switches if the wiring of the black and red lead wires to the AC wiring is reversed. In the MAESTRO® dimmer switch, the third hookup wire, i.e., the control wire, is blue.

Commonly assigned U.S. patent application Ser. No. 08/614,712 filed Mar. 13, 1996 entitled "Lighting Control with Wireless Remote Control and Programmability" (the 712 application) incorporated herein by reference in its entirety discloses a dimmer switch similar in many respects to the MAESTRO® dimmer switch, but with the added feature of wireless remote control capability. According to the 712 application, an infra-red receiver is disposed within the dimmer switch and is responsive to infra-red commands from a handheld infra-red transmitter to adjust the dimming level. A commercial embodiment of such a dimmer switch is presently available from Lutron under the trademark SPACER™, and is more fully described in the Lutron publications entitled "SPACER™ Personal Space Light Control" (P/N 360-487), "Introducing SPACER™ Personal Space Light Control" ((P/N 362-899) and "SPACER™ Personal Space Light Control" (P/N 360-486), all of which are incorporated herein by reference. The SPACER™ dimmer switch also supports hard-wired remote switches that can be used to control the dimming level in much the same manner as the MAESTRO® dimmer switch. The SPACER® dimmer switch suffers from the same drawbacks as above described in connection with the 919 patent and the MAESTRO® dimmer switch.

The above described dimmer switches and their respective remote switches do not require connection to the neutral line of the AC source for their operation. But some dimmer switches that use controllable conductive devices (such as a triac) to control electronic loads do require a connection to the neutral line. Additionally, a neutral wire may be necessary when using a dimmer switch with a power supply in order to allow small loads (e.g., 25 watts) to be controlled. In a building with electronic loads and three-way and four-way switches that is being retrofitted with new controls that include a dimmer switch, it is possible that the neutral line is only located in one of the particular wall boxes. If this particular wallbox happens to be electrically situated between the wallbox wired to the line side and the wallbox wired to the load side, none of the above described dimmers can be used for the reasons previously explained, at least not without expensive rewiring.

The ONSET® dimmer switch from Lightolier Controls, 2413 South Shiloh Road, Garland, Tex. 75041, and its associated remote devices use only two switches on the dimmer switch or the remote devices to perform multiple location dimming and on/off control. This dimmer switch is location dependent, i.e., it is incapable of being wired into a wall box wired for a four way switch. It also is wiring arrangement dependent, and the load current carrying wires cannot be interchangeably wired to the AC wiring. Systems of this type, modified as described herein, are considered to be within the scope of the instant invention.

So-called "cycle" or "touch" dimmer switches, such as those manufactured by Leviton Manufacturing Co., Inc., 59-25 Little Neck Parkway, Little Neck, N.Y. 11362, and others, can be used in a multiple location switching system, but are also location dependent and wiring arrangement dependent. This type of dimmer switch has a plate that, when quickly touched, toggles the load, and when touched continuously, cycles the dimming level up and down until the touch is removed.

It is desirable to provide a dimmer switch and switch system that overcomes the above shortcomings, and in particular, wherein the dimmer switch is location independent and wiring polarity independent. The present invention achieves these goals.

SUMMARY OF THE INVENTION

According to the present invention, there is provided a wall mountable dimmer switch for controlling the level of AC power delivered from an AC source to a load, such as a lighting load. The dimmer switch of the present invention is particularly adapted for use in a multiple location switch system having at least three switch locations (i.e., a four-way switch system) although the present dimmer switch may be employed in three-way applications and as a stand alone (i.e., single pole) switch. The dimmer switch of the present invention may be wired into any one of the multiple switch locations, without regard to the arrangement of the wiring of the hot and dimmed hot lead wires of the dimmer switch to the AC system wiring.

A dimmer switch according to the present invention comprises an electronic dimming circuit, preferably including a microprocessor that, in response to input data, provides an output signal that controls the firing angle of a triac in the dimming circuit. When employed in a multiple location switch system, the switch system preferably includes at least one remote device that, in response to actuation of intensity raise, intensity lower and toggle on/off switches disposed on the remote device, provide control signals over the AC system wiring to the dimmer switch. An auxiliary circuit is provided with signal and location detection circuitry. This circuit provides signals to the microprocessor; the microprocessor also receives signals from the zero crossing detector that indicate the polarity of the present half cycle of the AC source. The microprocessor determines, based upon these signals, whether to increase or decrease the power level to the load, or whether to toggle the on/off. As a result, the dimmer switch can be wired into any one of the locations of a multiple location switch system, without regard to the wiring of the hot and dimmed hot lead wires to the AC system wiring, while remaining responsive to the control signals from all of the remote switches in the system.

DESCRIPTION OF THE DRAWINGS

FIG. 6 is a chart illustrating the operation of block 33 of FIGS. 3 and 5.

FIG. 9 is a chart illustrating the operation of block 33 of FIG. 8.

DETAILED DESCRIPTION OF THE PREFERRED EMBODIMENT

Figure 1:
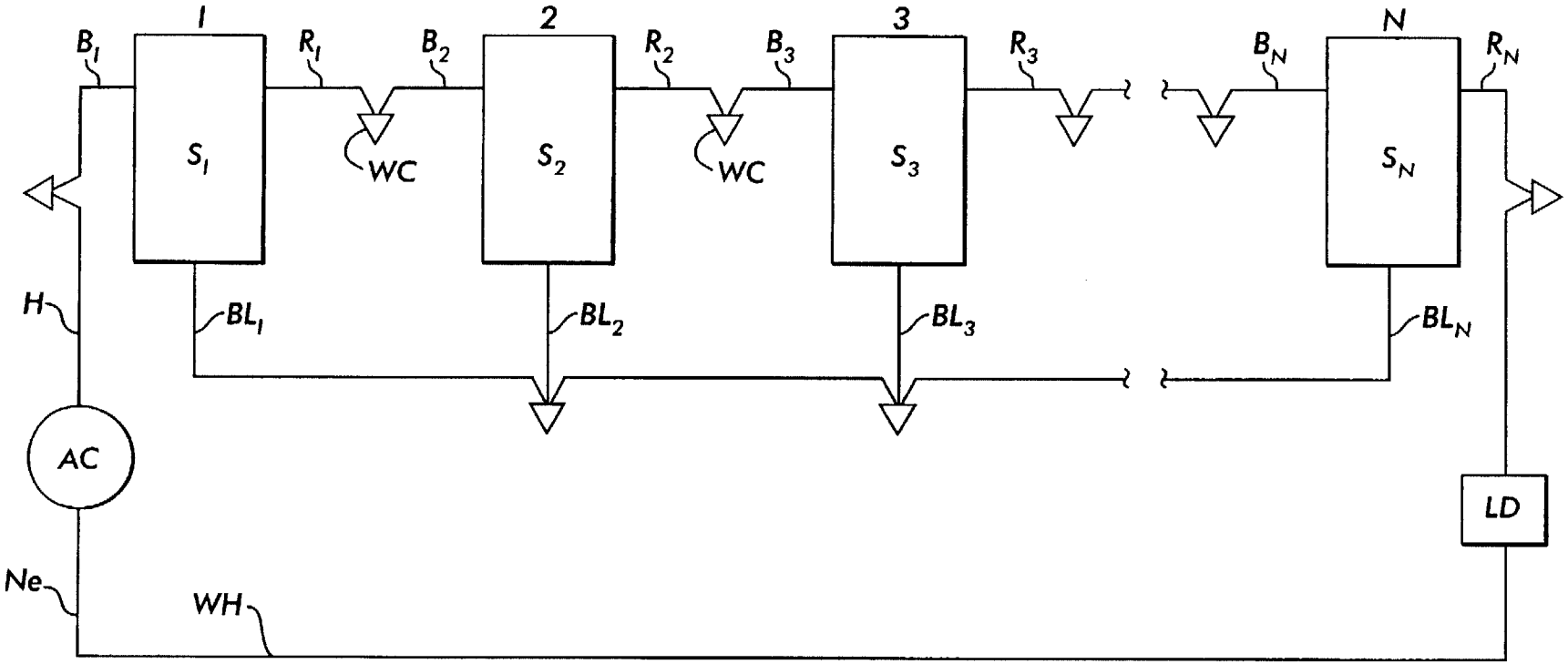
FIG. 1 schematically illustrates the wiring of a plurality of switches $S_1$ through $S_N$ to an AC source and load.

The present invention is described herein as an improvement to the dimmer switch disclosed in the 919 patent, and more particularly, as an improvement to the MAESTRO® commercial embodiment thereof, but it should be understood that this is merely one preferred embodiment of carrying out the invention. The present invention is not limited to this particular disclosure, or to application in these particular types of dimmer switches, except as expressly set forth in the following claims. The present invention has applicability to any electronic dimmer switch, and to any multiple location dimming system. The present invention is described herein for use in controlling AC loads, but has particular application to controlling lighting loads.

Referring now to the drawings, wherein like numerals and letters represent like elements, the following labeling conventions are used in the FIGS.

B=black wire

R=red wire

BL=blue wire

WH=white wire

AC=alternating current source (typically 120 volts RMS)

H=line side of the switch system, or hot lead wire of a switch, as appropriate

Ne=neutral (AC source) wire

WC=wire connector

S=switch

DS=dimmer switch

LD=load l=lower switch r=raise switch t=toggle switch

Turning now to FIG. 1, there is shown a system wiring diagram for a multiple location switching system, having N locations, 1 through N, each wired to receive a switch S. Each location N is preferably defined by a NEMA standard 3" high by 1 31/32" wide wall box, and each switch $S_1$ through $S_N$ is adapted to be received therein and wired to AC wiring present therein, as more fully described below. If the switching system employed is the above described MAESTRO® switching system, then the dimmer switch may be wired only at locations 1 or N, and not intermediate thereto, and the remaining switches S may be the above described remote switches (see the 919 patent for further details). Thus, if the dimmer switch is the switch $S_1$ wired at location 1, then the remaining switches $S_2$ through $S_N$ wired at locations 2 through N are the remote switches, and the dimmer switch $S_1$ must be wired as shown, i.e., the black wire $B_1$ of switch $S_1$ (i.e., the hot lead wire of $S_1$) must be wired to the line H and the red wire $R_1$ (i.e., the dimmed hot lead wire of $S_1$) should be wired to the black wire $B_2$ of the remote switch $S_2$, etc., as shown. The system will still function if the arrangement of any of the red R and black B wires of any of the remote switches is reversed, e.g., if the red wire $R_2$ of remote switch $S_2$ is wired to the red wire $R_1$ of the dimmer switch S1. As also shown, each of the switches S is interconnected by a control wire BL, which, as mentioned, is the blue wire of the prior art MAESTRO® switches. Each of the B, R and BL wires, the source (AC) and the load (LD) is shown as being interconnected by means of system wiring and wire connectors WC. It will be appreciated that the B and R wires (defining, for purposes of this application, first and second hookup wires) are subjected to source voltage and carry the full current drawn by the load LD; the BL wires are subjected to source voltage and carry low current, as their function is merely to communicate signals to the dimmer switch. As shown, the neutral wire (Ne), which is usually the white wire (WH) in an installation wired according to the National Electrical Code, does not need to be wired to any of switches S, and therefore the WH wire need not be, but can be, carried through any of the locations 1 through N. Thus, for purposes of this application, the term "AC wiring", when used to describe the wiring interconnecting the locations 1 through N means at least the wires interconnecting the locations 1 through N needed to connect the B and R wires of the switches S, and the term may include (but for purposes of the appended claims, does not necessarily include, except as specified therein or as may be implicit therein) the wires interconnecting the locations 1 through N needed to connect the BL wires of the switches S, as well as the wires connecting location 1 to the source and location N to the load.

According to the present invention, the dimmer switch may be wired into any of the locations 1 through N, and the wiring of the B and R wires thereof wires may be reversed, and the system will operate properly. In other words, the dimmer switch of the present invention is location independent and wiring arrangement independent.

Figure 2:
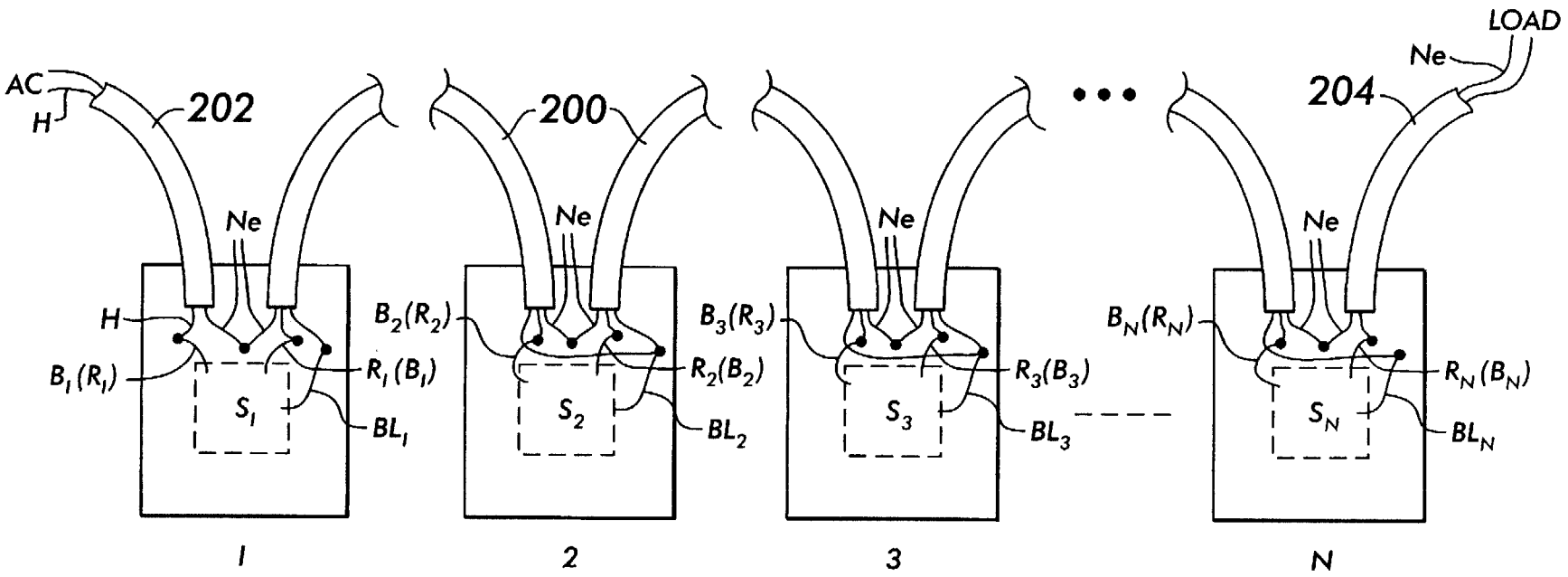
FIG. 2 illustrates details of one AC wiring scheme for interconnecting a plurality of switch locations I through N and for connecting the first and last locations to the source and load, respectively.

In FIG. 2, the AC wiring 200 interconnecting the locations 1 through N is shown as having three wires. Preferably, the wiring 200 is three conductor wire, such as type NM 14/3 or 12/3 wiring. Two conductor wire, such as type NM 14/2 or 12/2, is preferably employed to interconnect location 1 to the source (wire 202), and to interconnect location N to the load (wire 204). In the illustrated wiring diagram of FIG. 2, the neutral Ne is shown as being carried through each of the locations 1–N, but, as mentioned above, this is not necessary, and other wiring schemes are permissible. FIG. 2 illustrates the feature of the present invention that, irrespective of which of the locations 1 through N the dimmer switch of the present invention is wired, the wiring of the B or R wires to the AC wiring is independent; this is illustrated by the use of parenthesis at each location, e.g., $B_N$ ($R_N$). It will be seen that the AC wiring 200 also interconnects the BL wires, which are wired as shown in FIG. 1 to carry the control signals to the dimmer switch. In the example of FIG. 2, the dimmer switch may be any one of the switches $S_1$–$S_N$. It will be appreciated that the particular wires of wiring 200 that interconnect the B and R wires of the switches $S_1$ through $S_N$ define an AC load current carrying line, and that, when the B and R wires are connected thereto, they define a portion of the AC load current carrying line.

Figure 3:
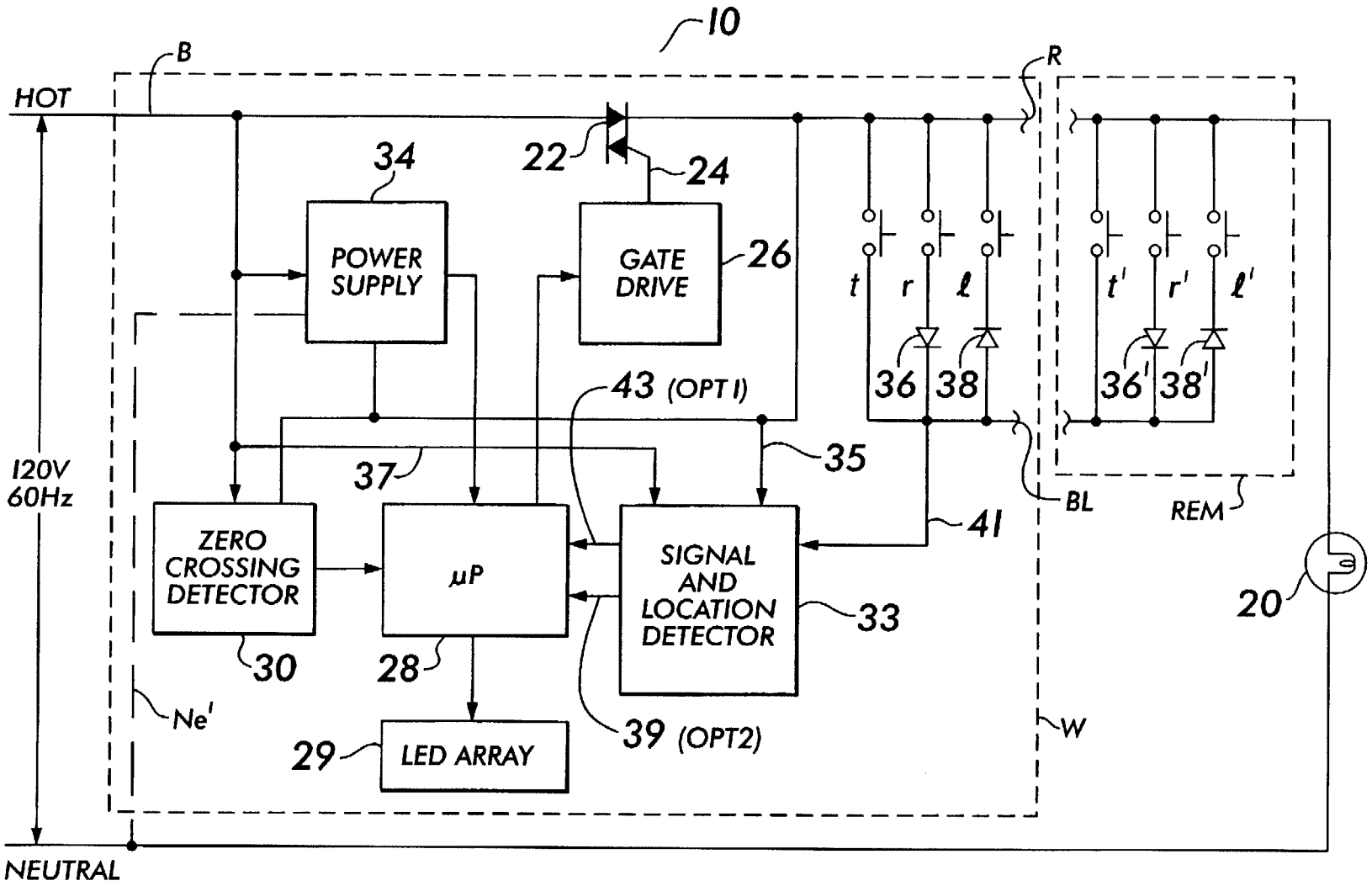
FIG. 3 is a block diagram of a dimmer switch according to one embodiment of the present invention.

FIG. 3 illustrates, in block diagram form, a dimmer switch 10 according to the present invention. As mentioned, dimmer switch 10 hereof may be the same dimmer switch 10 described in the 919 patent, and the MAESTRO® commercial implementation thereof, modified as described herein. Elements 20, 22, 24, 26, 28, 29, 30, 34, 36, 36', 38 and 38' (and, except as noted, the interconnections) of FIG. 3 hereof are identical to those of FIG. 2 of the 919 patent, and therefore the 919 patent's description of its dimmer switch 10 is applicable to FIG. 3 hereof. Accordingly, a detailed description of FIG. 3 hereof is not required here, and reference is made to the 919 patent therefor. It will suffice to say that signal and location detector 33 serves the function of receiving signals from local switches "t", "r" and "T" and remote switches labeled "REM" in FIG. 3, and providing the same to microprocessor 28, which is responsive thereto to increase or decrease the dimming level, or to toggle the load on/off. In particular, when the actuator for the "T" switch is actuated at one of the local switches (or the auxiliary switches REM), diode 38 (38') permits only half cycles of one polarity of the source voltage to be communicated over the AC wiring interconnecting the BL wires to the signal and location detector 33. Similarly, actuation of the actuator for the "r" switch (together with operation of diode 36, 36') permits communication of only half cycles of the other polarity. Actuation of the actuator for the "t" switch (which has no associated diode) permits communication of full cycles. Each of these signals, which is either full AC (actuation of "t" switch) or rectified AC (actuation of "T" or "r" switches), and which has the magnitude of the AC source, is converted to logic levels by signal and location detector 33 suitable for input to microprocessor 28. Microprocessor 28 is programmed to be responsive thereto, and to an input from a zero crossing detector 30, to raise or lower the dimming level or to toggle the load on/off. Each actuator for the "T" and "r" switches is a user operable actuator, preferably in the form of a rocker actuator or the like, and the actuator for the "t" switch is preferably in the form of a push button actuator, as in the MAESTRO® dimmer switch.

In certain embodiments, it may be desirable to design the dimmer switch 10 so that the power supply 34 thereof (and other circuit elements, if desired) receive and utilize the neutral line of the system wiring. This is shown by the dashed line Ne' in FIG. 3.

In FIG. 3, the designations B, R and BL have been provided to designate the wires previously discussed. According to the present invention, the circuitry (FIG. 2) of the 919 patent is modified in that a location detector has been added, and interconnections 37 and 35 to the hot (B) and dimmed hot (R) sides of triac 22 are provided to the signal and location detector 33, as shown. Signal location detector 33 defines "auxiliary circuitry". A connection 41 between the control wire BL and signal and location detector 33 is also provided. Signal and location detector 33 provides inputs to microprocessor 28 on line 39 and line 43. Programming of microprocessor 28 is also modified as described hereinafter. As explained hereinafter, signal and location detector 33 provide inputs to the microprocessor 28 for processing, along with inputs from the zero crossing detector 30. This is described in further detail hereinafter.

This feature of the present invention not only permits the dimmer switch to be wired into any of the locations 1 through N while preserving the operation of all of the auxiliary switches, it also permits the hot (B) and dimmed hot (R) lead wires of the dimmer switch to be interchangeably wired to the AC wiring.

Figure 4:
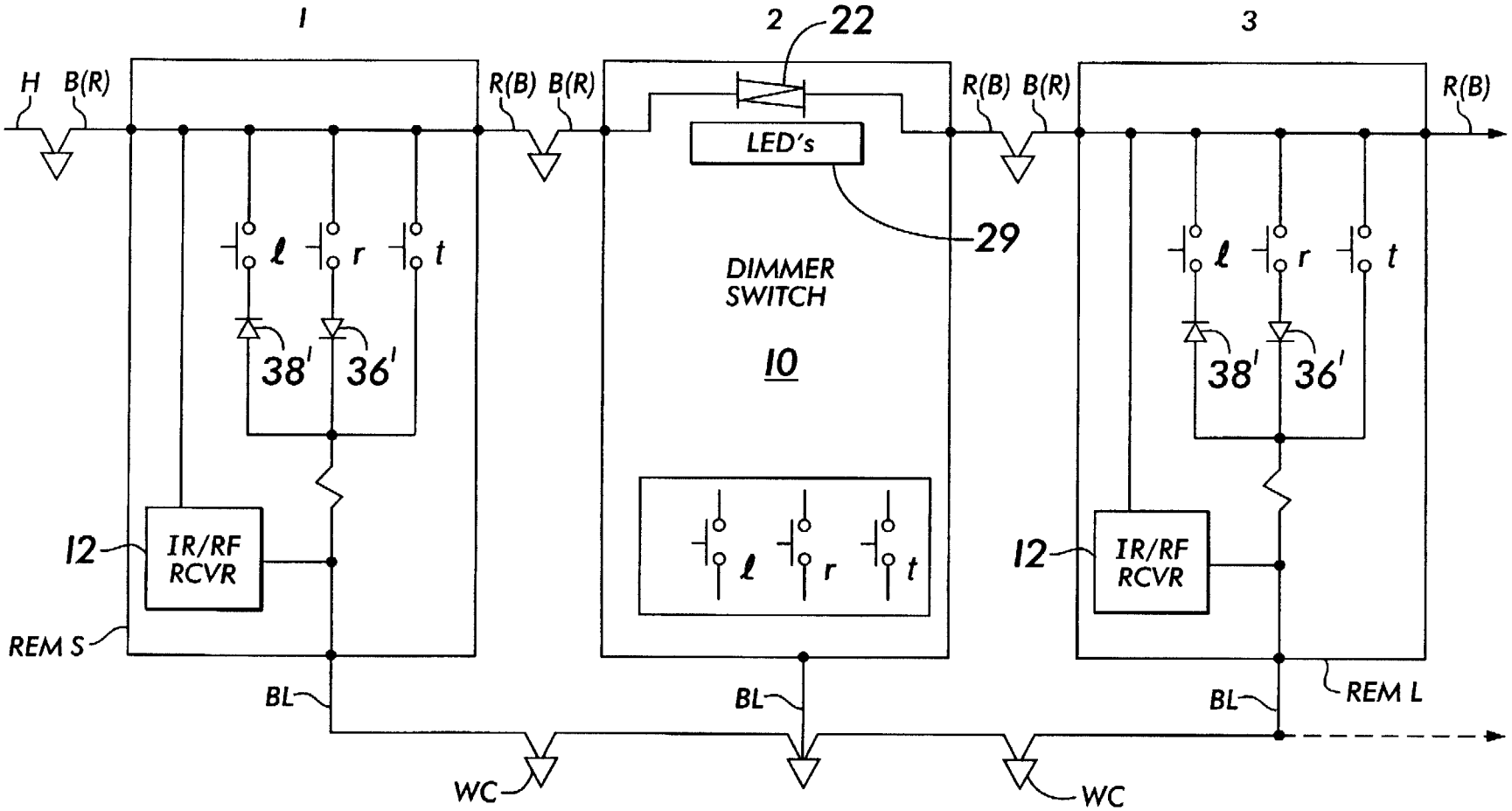
FIG. 4 illustrates further features of remote devices for use in connection with the present invention, and one preferred method of wiring the same to the dimmer switch of the present invention.

FIG. 4 illustrates further features and details of the present invention. In FIG. 4, the dimmer switch 10 is shown as being wired in location 2, i.e., electrically situated between the remote switches wired in locations 1 and 3 through N. The remote switch on the source side of dimmer switch 10 is labeled REM S, and the remote switch on the load side of dimmer switch 10 is labeled REM L. Each remote switch comprises "T", "r" and "t" switches, and diodes 36', 38', as above described, and as further described in the 919 patent. However, in accordance with yet another aspect of the invention, each remote switch may be provided with an infrared (IR) or radio frequency (RF) receiver 12 adapted to receive commands from a hand held IR or RF remote transmitter having similar "T", "r" and "t" switches thereon that provides, in response to actuation thereof, IR or RF signals indicative of desired lower, raise and toggle on/off conditions. The IR/RF receiver 12 is responsive to receipt of such signals to provide the same AC signals (negative half cycle only, positive half cycle only, or full cycle) on the control wire BL as are provided when any of the hard-wired switches "T", "r" and "t" on the remote switches are actuated. The IR/RF receivers 12 may be provided in addition to the hard-wired switches, or, may be implemented as part of a remote unit that is only a receiver having no local controls. Moreover, an IR/RF receiver may be provided in the dimming switch 10 (not shown), if desired. It will be appreciated from both FIGS. 3 and 4 that the dimmer switch 10 is preferably provided with local "T", "r" and "t" switches for carrying out dimming level and toggle on/off functions locally at the dimmer switch. It should also be noted that the B(R) convention has been employed to indicate that the wiring of the B and R hookup wires is reversible. Implementation of the IR/RF transmitter and receiver functions will be readily apparent to those skilled in the art, and therefore details thereof are not provided herein. For example, the above referenced 712 application, and the above referenced SPACER™ lighting control unit, teach such an implementation. U.S. Pat. Nos. 5,005,211; 5,099,193; 5,146,153; and, 5,237,264, each of which is incorporated herein by reference, also teach implementation of an IR remote control system.

FIG. 4 illustrates each of the remote switches REM as having two conductors, labeled B and R, both of which are subject to source voltage and carry full load current during system operation. In the above mentioned MAESTRO™ commercial implementation, the remote switches are provided with mechanical, user operable, air gap switches not shown, and the B and R wires are coupled to opposite sides of the air gap switch. Those skilled in the art will readily appreciate that only one conductor for connection to the system wiring is required if the air gap switch is not employed. Thus, it is possible to provide a remote switch having only two lead wires, i.e., a control wire (BL) and a wire for connection to the system wiring and, in operation, both of which are subject to source voltage but do not carry full load current. A system employing such a switch is within the scope of this invention.

Figure 5:
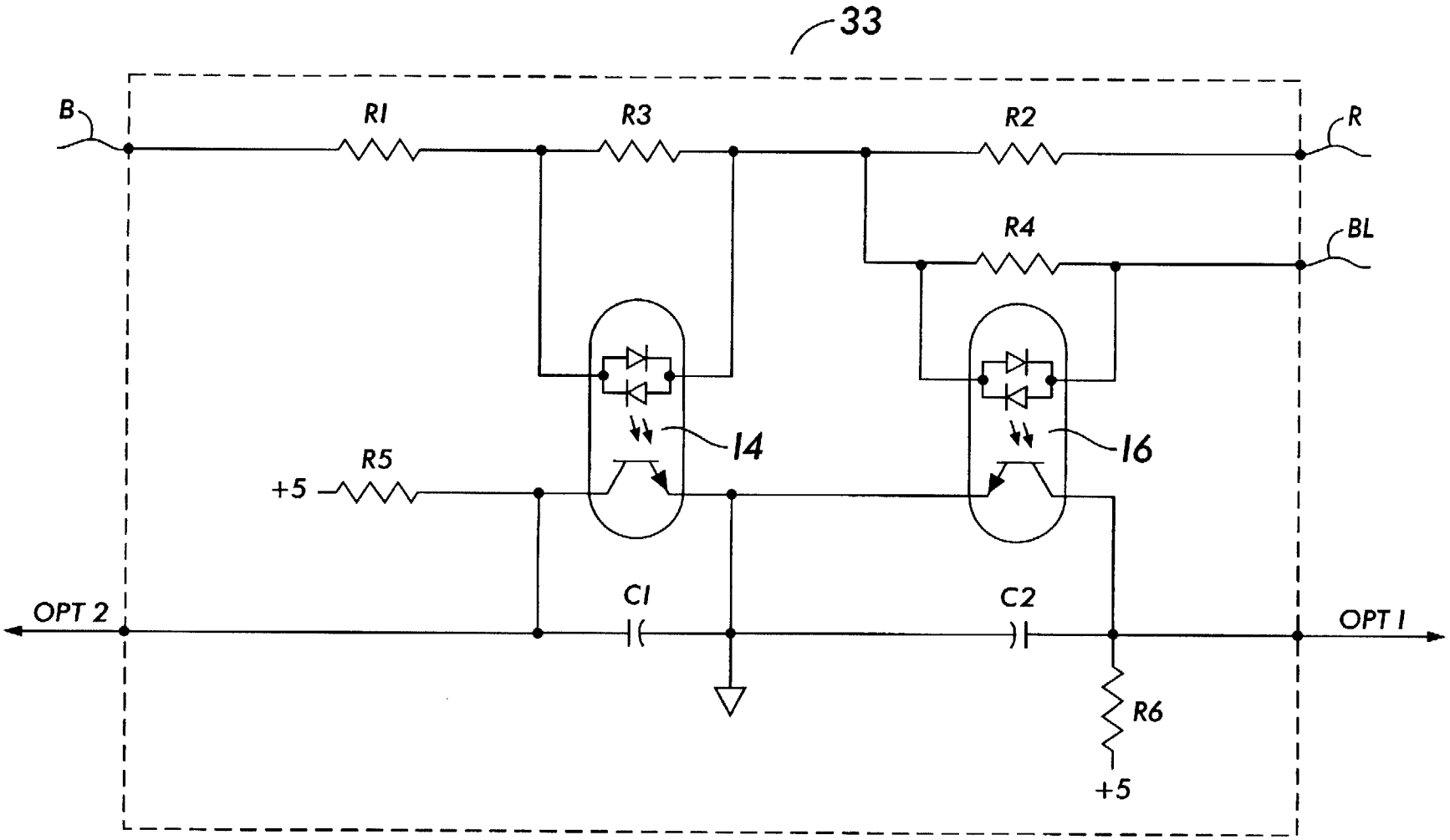
FIG. 5 illustrates one preferred circuit implementation for block 33 of FIG. 3.

Turning now to FIG. 5, circuitry for implementing block 33 of FIG. 3 is illustrated. Essentially, the signal and location detector 33 comprises optical isolators 16, 14 and voltage divider (R1, R2, R3) circuitry for providing a pair of logic outputs OPT1 and OPT2 that change state depending upon the nature of the command ("T", "r" or "t"), its direction of origin relative to the dimmer switch, and, in some cases, the present half cycle (positive or negative) of the waveform of the AC source. Generally speaking, opto-isolator 14, resistor R3, and capacitor C1 and opto-isolator 16, resistor R4 and capacitor C2 define signal and location detector 33. Since OPT1 and OPT2 may, in some cases, change state with changes in the polarity of the AC source waveform from positive to negative, and negative to positive, the microprocessor 28 must be provided with input indicative of when such changes in the AC source waveform occur so that it can properly interpret the OPT1 and OPT2 inputs. That is the function of zero crossing detector 30 in FIG. 3. In one preferred embodiment of the invention, the values of the components R1–R6, C1 and C2 are as follows:

| | |
|---|---|
| R1, R2 | 33 Kohm |
| R3 | 4.7 Kohm |
| R4 | 1 Kohm |
| R5, R6 | 7.5 Kohm |
| C1, C2 | 0.1 uF |
| Opto isolators 14, 16 | Toshiba P/N TLP-620-D4-6B |

Though the disclosed circuitry employs optical isolators for isolating the AC side from the low voltage digital side, those skilled in the art will readily appreciate that other isolation devices, such as transformers, may be employed, and that a dimmer switch without any isolation devices may be provided. Both of these alternatives are considered to be within the scope of the present invention.

The operation of the circuitry of FIG. 5 is best illustrated by reference to both FIGS. 4 and 5, and by discussion of the current paths for various actuations of the switches "T", "r" and "t" of the remote switches REM S and REM L. In the following discussion, the current path is described in relation to the circuit components of FIG. 5; references to B, R and BL are to the wires labeled B, R and BL in FIG. 5.

1) Actuation of "t" on REM S

During all half cycles, the main current path is the same, since there is no diode in the current path when "t" on REM S is closed. The main current path is defined by BL, R4, R2 and R. Some of the current also flows through opto-isolator 16. Opto-isolator 16 is therefore "on", and OPT1 is low (L) (essentially ground), for all half cycles during which "t" is closed. No current flows through R3, and therefore opto-isolator 14 is "off" and OPT2 is high (H) (+5 v) for all half cycles during which "t" is closed.

2) Actuation of "t" on REM L

During all half cycles, the main current path is the same, since there is no diode in the current path when "t" on REM L is closed. The current path is defined by BL, R4, R3, R1 and B. Some of the current also flows through opto-isolators 14 and 16. Opto-isolators 14 and 16 are therefore both "on", and both OPT1 and OPT2 are low for all half cycles during which "t" is closed.

Hereafter, it will be appreciated that whenever current flows through R3, some current will also flow through opto-isolator 14; and that, whenever current flows through R4, some current will also flow through opto-isolator 16.

3) Actuation of "r" on REM S

When "r" on REM S is closed, diode 36' of REM S conducts during positive half cycles. During positive half cycles, the current path is defined by BL, R4, R2 and R, and no current flows through R1 or R3; during this time opto-isolator 16 is "on" and opto-isolator 14 is "off", and thus OPT1 is low and OPT2 is high. During negative half cycles, the current path is defined by R, R2, R3, R1 and B; during this time, opto-isolator 16 is "off" and opto-isolator 14 is "on", and thus OPT1 is high and OPT2 is low.

4) Actuation of "r" on REM L

When "r" on REM L is closed, diode 36' of REM L conducts during negative half cycles. During negative half cycles, the current path is defined by B, R1, R3, R4 and BL, and no current flows through R2; during this time both opto-isolators 14 and 16 are "on", and thus OPT1 and OPT2 are low. During positive half cycles, the current path is defined by B, R1, R3, R2, and R; during this time, opto-isolator 16 is "off" and opto-isolator 14 is "on", and thus OPT1 is high and OPT2 is low.

5) Actuation of "T" on REM S

When "T" on REM S is closed, diode 38' on REM S conducts during negative half cycles. During negative half cycles, the current path is defined by BL, R4, R2 and R, and no current flows through R1 and R3; during this time, opto-isolator 16 is "on" and opto-isolator 14 is "off", and thus OPT1 is low and OPT2 is high. During positive half cycles, the current path is defined by B, R1, R3, R2 and R; during this time, opto-isolator 14 is "on" and opto-isolator 16 is "off", and thus OPT1 is high and OPT2 is low.

6) Actuation of "T" on REM L

When "T" on REM L is closed, diode 38' on REM L conducts during positive half cycles. During positive half cycles, the current path is defined by B, R1, R3, R4 and BL and no current flows through R2; during this time, both opto-isolators 14 and 16 are "on", and thus OPT1 and OPT2 are low. During negative half cycles, the current path is defined by B, R1, R3, R2 and R; during this time, opto-isolator 14 is "on" and opto-isolator 16 is "off", and thus OPT1 is high and OPT2 is low.

7) No Actuation

When no actuator is actuated, the current path is the same for both half cycles. The current path is B, R1, R3, R2 and R, and opto-isolator 14 is "on" and opto-isolator 16 is "off", and thus OPT 1 is high and OPT2 is low for both half cycles.

The above operation is summarized in FIG. 6. Microprocessor 28 may be programmed with a look-up chart similar to that of FIG. 6 to process the OPT1, OPT2 and zero crossing inputs, and provide the appropriate raise/lower or toggle on/off drive signals to gate drive circuitry 26 and triac 22.

Prior art dimmer switches cannot detect the direction of origin of the control signals from the remote switches, and this is one reason that prior art dimmer switches are incapable of being wired electrically intermediate the auxiliary switches. In the present invention, microprocessor 28 interprets the OPT1 and OPT2 signals along with the zero cross detector signals and carries out the correct dimming function.

Figure 7:
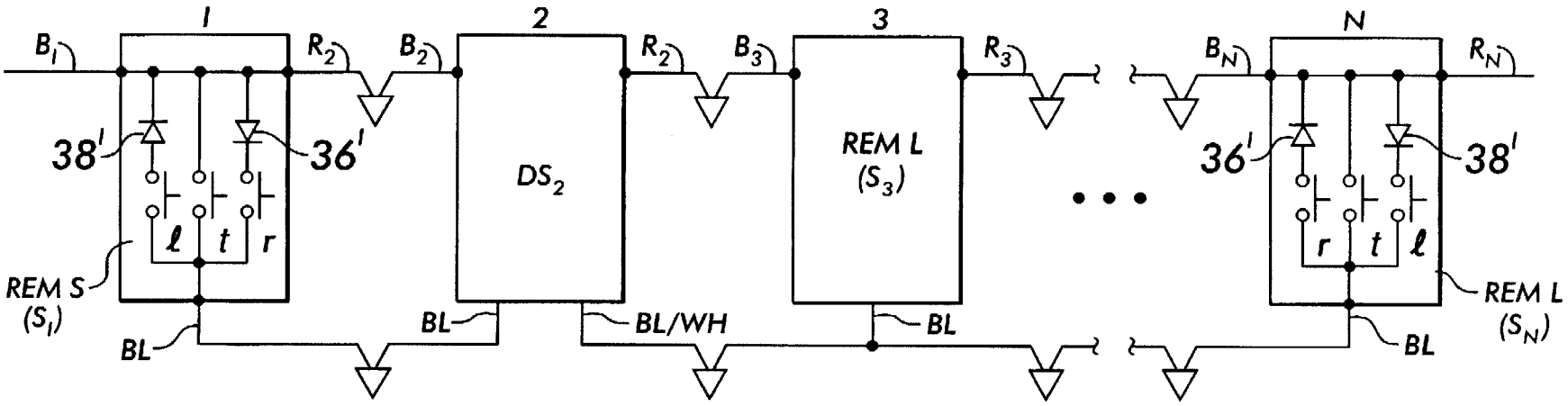
FIGS. 7 and 8 illustrate an alternative embodiment to the embodiment illustrated in FIGS. 4 and 5 for carrying out the present invention.
Figure 8:
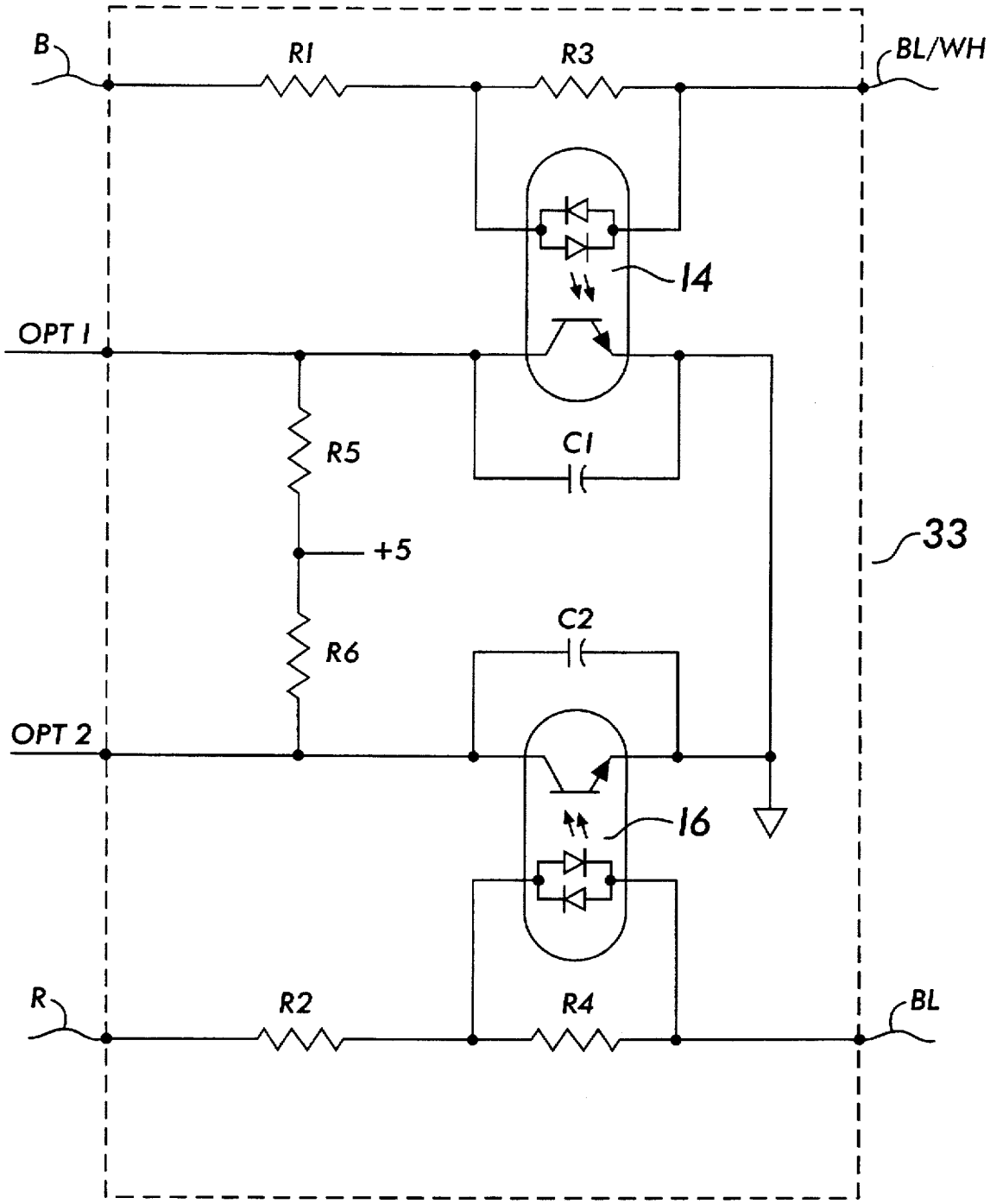

FIGS. 7 and 8 illustrate an alternative embodiment of the invention wherein, instead of a single control wire BL, the dimmer switch employs a pair of control wires BL and BL/WH (BL in the embodiment illustrated) over which control signals are communicated by the remote switches. In the embodiment of FIG. 7, remote switches wired on the line side of the dimmer switch DS have their control wire BL wired to one of the BL or BL/WH (BL/WH in the embodiment illustrated) control wires of the dimmer switch, and the remote switches wired on the load side of dimmer switch have their control wire BL wired to the other one of BL or BL/WH control wires of the dimmer switch. FIG. 8 illustrates circuitry for generating the signals OPT1 and OPT2 in this alternative embodiment. Circuit components in FIG. 8 have been labeled with like designations as in FIG. 5 to indicate like component values as set forth above with the exception of R3, which is 1 Kohm in this embodiment. FIG. 9 is a chart illustrating the outputs of OPT1 and OPT2 of FIG. 8 for various conditions of the "r", "T" and "t" switches at positive and negative cycles of the AC waveform, and for the "r", "T" and "t" switches on remote switches connected on both the line and the load side of the dimmer switch.

The operation of the circuit of FIG. 8 will be readily apparent to one skilled in the art after having read and understood the above description of the operation of FIG. 5. By way of example, the operation of the "r" actuator on REM S and of the "T" acturator on REM L is as follows:

1) Actuation of "r" on REM S

When "r" on REM S is closed, diode 36' of REM S conducts during positive half cycles. During positive half cycles, the current path is defined by BL, R4, R2, R; during this time, opto-isolator 16 is "on" and thus OPT2 is low. During negative half cycles, there is no current path; during this time opto-isolator 16 is "off" and thus OPT2 is high. The status of the output from OPT1 is irrelevant.

2) Actuation of "T" on REM L

When "T" on REM L is closed, diode 38' of REM L conducts during positive half cycles. During positive half cycles, the current path is defined by B, R1, R3, BL/WH; during this time, opto-isolator 14 is "on" and thus OPT1 is low. During negative half cycles, there is no current path; during this time, opto-isolator 14 is "off" and thus OPT1 is high. The status of the output from OPT2 is irrelevant.

Though the present invention has been described for use in a multiple location switch system, it will be appreciated that the instant dimmer switch is capable of stand-alone use, as well as in three and four way applications.

In either case, it is preferred that the dimmer switch and remote switches described above be wall mountable, preferably for mounting in a NEMA standard 3" high by 1 31/32" wide wall box The present invention may be embodied in other specific forms without departing from the spirit or essential attributes thereof, and accordingly, reference should be made to the appended claims, rather than to the foregoing specification, as indicating the scope of the invention.

We claim:

1. A wall mountable dimmer switch for controlling the level of AC power delivered from an AC source to a load in a lighting control circuit having N switch locations each for receiving a device for controlling the load, where N is at least 3, the N switch locations being interconnected by AC wiring which is subjected to AC line voltage and at least one line being an AC load current carrying line, comprising:

a) a dimming circuit and hookup wires for connecting the dimmer switch to the AC wiring at one of the N locations; and, b) auxiliary circuitry connected to the dimming circuit enabling remote devices wired to the AC wiring at the remaining ones of the N locations, and the dimmer switch, to control the load irrespective of which one of the N locations wherein the dimmer switch is wired to the AC wiring.

2. The wall mountable dimmer switch according to claim 1 wherein there is at least a pair of said hookup wires that, when connected to the AC wiring, defines a portion of said AC load current carrying line, the auxiliary circuitry further enabling the dimmer and the remote devices to control the load irrespective of the manner in which said pair of hookup wires is connected to the AC wiring circuit to define said portion of said AC load current carrying line.

3. The wall mountable dimmer switch according to claim 1 wherein there is at least a pair of said hookup wires that, when connected to the AC wiring, defines a portion of said AC load current carrying line, there also being another wire, defining a control wire, coupled to the auxiliary circuitry for connection to the AC wiring for communicating commands to the dimmer switch from the remote devices.

4. The wall mountable dimmer switch according to claim 3 wherein the commands comprise intensity raise, intensity lower and on/off commands.

5. The wall mountable dimmer switch according to claim 4 wherein the commands are communicated as control signals, and wherein, when connected to the AC wiring, the dimmer switch has a source side and a load side, and the control signals for at least ones of the commands differ depending upon whether the control signals originate from a remote device on the source side or a remote device on the load side of the dimmer switch, and wherein the dimming circuit comprises a microprocessor and the auxiliary circuitry comprises circuitry for processing the control signals and for providing outputs to the microprocessor that vary depending upon the origin of the control signals, the microprocessor being responsive to the outputs to either increase or decrease the level of power delivered to the load or to turn the load on or off based upon the outputs.

6. The wall mountable dimmer switch according to claim 5 wherein the auxiliary circuit comprises a first and a second optical isolator for receiving the control signals and configured to provide a first arrangement of logical outputs when the control signals originate from the source side and a second arrangement of logical outputs when the control signals originate from the load side.

7. The wall mountable dimmer switch according to claim 6 wherein there is a plurality of current paths defined in the auxiliary circuit, the control signals employing different ones of the current paths based upon the command communicated, the instantaneous polarity of the AC source, and whether the control signals originated from the source side or load side of the dimmer switch, and wherein the first and second optical isolators are responsive to the particular current path employed by the control signals to provide the first and second arrangements of logical outputs.

8. The wall mountable dimmer according to claim 1 wherein the dimmer switch is adapted to be mounted in a NEMA standard 3" high by 1 31/32" wide wall box.

9. A lighting control system for controlling the level of AC power delivered from an AC source to a load from a plurality, N, of locations, where N is at least 2, comprising:

a) a wall mountable microprocessor based dimmer switch for installation at one of the N locations and comprising three hookup wires for connection to AC wiring interconnecting the N locations, the AC wiring being subjected to AC line voltage and at least one line being an AC load current carrying line, a pair of the hookup wires being for connection to the AC wiring so as to define a portion of said AC load current carrying line, the third hookup wire defining a control wire for receiving commands to be communicated to the microprocessor, the microprocessor being responsive to actuation of one or more user actuatable switches located at the dimmer switch and to receipt of commands communicated as control signals over the control wire to control the load, including to alter the level of power delivered to the load; and, b) N−1 wall mountable remote devices for installation at the remaining N−1 ones of the N locations, the remote devices generating, in circuit operation, the commands in response to actuation of user actuatable switches located at each of the remote devices, each remote device comprising at least one hookup wire for wiring to the AC wiring which defines a portion of said AC load current carrying line and another hookup wire for wiring to the AC wiring to communicate the commands as said control signals thereover to the dimmer switch;

the dimmer switch comprising enabling means for enabling the load to be controlled by any of the devices at any of the N locations irrespective of the manner in which the pair of hookup wires of the dimmer switch is connected to the AC wiring to define said portion of the AC load current carrying line.

10. The system according to claim 9 wherein N is at least 3 and said enabling means is operative to enable the dimmer switch and the remote devices to control the load irrespective of which of the N locations in which the dimmer switch is installed.

11. The system according to claim 9 wherein N is at least 3 and said enabling means is operative to enable the dimmer switch and the remote devices to control the load irrespective of the location of the dimmer switch in the AC wiring relative to the locations of the remote devices.

12. The system according to claim 9 wherein, when connected to the AC wiring, the dimmer switch has a source side and a load side, and the control signals for at least ones of the commands differ depending upon whether the control signals originate from a remote device on the source side or a remote device on the load side of the dimmer switch, and said enabling means comprises circuitry for processing the control signals and for providing outputs that vary depending upon the origin of the control signals.

13. The system according to claim 12 wherein said enabling means further comprises a program stored in a memory that in combination with the microprocessor defines a microcontroller, the microcontroller operating under control of said program so as to respond to the outputs provided by the circuitry for processing the control signals to either increase or decrease the level of power delivered to the load depending upon the outputs.

14. The system according to claim 12 wherein the control signals have voltage amplitudes substantially equal to the amplitude of the voltage of the AC source, and the circuitry for processing the control signals comprises a first and a second optical isolator for receiving the control signals and configured to provide a first arrangement of logical outputs when the control signals have originated from the source side of the dimmer switch and a second arrangement of logical outputs when the control signals have originated from the load side of the dimmer switch.

15. The system according to claim 14 wherein said circuitry for processing the control signals provides a plurality of current paths, the AC control signals employing different ones of the current paths based upon the command communicated, the instantaneous polarity of the AC source, and whether the commands originated from the source side or load side of the dimmer switch, and wherein the first and second optical isolators are responsive to the particular current path employed by the AC control signals to provide the first and second arrangements of logical outputs.

16. The system according to claim 12 wherein at least a selected one of the dimmer switch or the remote devices further comprises a receiver for receiving commands from a wireless hand-held remote control unit, the receiver being responsive to receipt thereof to communicate the commands to the dimmer switch.

17. The system according to claim 16 wherein the receiver is one of an infra-red or radio frequency receiver.

18. The system according to claim 9 wherein the dimmer switch and each auxiliary switch is adapted to be mounted in a NEMA standard 3" high by 1³¹⁄₃₂" wide wall box.

19. A lighting control system comprising:

a) a wall mountable dimmer switch for connection to AC wiring interconnecting an AC source, a load and a plurality N of switch locations, where N is at least 3, the AC wiring having an AC load current carrying line, the dimmer switch having dimming circuitry for controlling a level of power to be delivered from the AC source to the load; and, b) a plurality N−1 of wall mountable remote devices for connection to the AC wiring for controlling the dimmer switch, one of the remote devices being connectable to the AC wiring at a first switch location that is electrically closest to the AC source, and another one of the remote devices being connectable to the AC wiring at an Nth switch location that is electrically closest to the load, the dimmer switch being connectable at a switch location electrically intermediate the first and Nth switch locations;

the dimmer switch comprising enabling means enabling the dimmer switch and all remote devices to be operative to control the load from any of the N switch locations.

20. The system according to claim 19 wherein each of the remote devices comprises at least one switch operative to adjust the level of power delivered to the load.

21. The system according to claim 19 wherein the dimmer switch comprises at least a pair of hookup wires and each of the remote devices comprise at least one hookup wire for connection to the AC load current carrying line, each of said hookup wires of said dimmer switch defining, when connected to the AC load current carrying line, a portion thereof; and wherein said means enables operation of the dimmer switch and the remote devices to control the load irrespective of the manner in which said hookup wires of the dimmer switch are connected to define said portion of said AC load current carrying line.

22. The system according to claim 21 wherein the dimmer switch and each remote device comprises another hookup wire for connection to the AC wiring for interconnecting the dimmer switch and each of the remote devices so as to enable communication of control signals generated by the remote devices thereover to the dimmer switch, the dimmer switch being responsive to the receipt of the control signals to alter the level of power delivered to the load.

23. The system according to claim 22 wherein, when connected to the AC wiring, the dimmer switch has a source side and a load side, and the control signals for at least ones of the commands differ depending upon whether the control signals originated from a remote device on the source side or a remote device on the load side of the dimmer switch, said enabling means comprising circuitry for processing the control signals and for providing outputs that vary depending upon the origin of the control signals.

24. The system according to claim 23 wherein the dimmer circuitry comprises a microprocessor for processing the outputs and for controlling, in response to the same, and in accordance with a stored program, a firing angle of a triac interposed between the AC source and the load.

25. The system according to claim 23 wherein the control signals have voltage amplitudes substantially equal to the amplitude of the voltage of the AC source, and the circuitry for processing the control signals comprises a first and a second optical isolator for receiving the control signals and configured to provide a first arrangement of logical outputs when the control signals have originated from the source side of the dimmer switch and a second arrangement of logical outputs when the control signals have originated from the load side of the dimmer switch.

26. The system according to claim 25 wherein said circuitry for processing the control signals provides a plurality of current paths, the AC control signals employing different ones of the current paths based upon the command communicated, the instantaneous polarity of the AC source, and whether the commands originated from the source side or load side of the dimmer switch, and wherein the first and second optical isolators are responsive to the particular current path employed by the AC control signals to provide the first and second arrangements of logical outputs.

27. The system according to claim 19 wherein the dimmer switch and each auxiliary switch is adapted to be mounted in a NEMA standard 3" high by 1 31/32" wide wall box.

28. The system according to claim 22 wherein a selected one of the dimmer switch or the remote devices comprise a receiver for receiving commands from a wireless hand-held remote control unit, the receiver being responsive to receipt thereof to communicate the commands to the dimmer switch.

29. The system according to claim 28 wherein the receiver is one of an infra-red or radio frequency receiver.

30. A wall mountable dimmer switch comprising an electronic dimming circuit, at least one user actuatable switch for adjusting the level of power delivered from an AC source to a load, and receiving and processing means for receiving and processing control signals generated from remote devices coupled to a lighting control circuit in which the dimmer switch is adapted to be disposed, the dimmer switch, when installed in the lighting control circuit, having a source side and a load side, the receiving and processing means further receiving and processing an indication of the polarity of the AC source, the receiving and processing means being responsive to control signals generated by remote devices on the source side and to the polarity indication to provide a first arrangement of data signals to the dimming circuit, and being responsive to control signals generated by remote devices on the load side and to the polarity indication to provide a second arrangement of data signals to the dimming circuit, the dimming circuit being responsive to the data signals to either increase or decrease a level of power delivered to the load, or to turn the load on or off, based upon the arrangements of the data signals.

31. The wall mountable dimmer switch according to claim 30 wherein the dimmer switch comprises at least a pair of hookup wires and each of the remote devices comprise at least one hookup wire for connection to the lighting control circuit, and wherein the receiving and processing means is responsive to the control signals to provide the data signals to the dimming circuit, and the dimming circuit is responisve thereto to alter the level of power delivered to the load, irrespective of reversal of the connection of the hookup wires of the dimmer switch to the lighting control circuit.

32. The wall mountable dimmer switch according to claim 30 wherein the control signals are generated in response to actuation of at least one user actuatable switch on the remote devices, and the receiving and processing means enables the dimming circuit to alter the level of power delivered to the load in response to actuation of the user actuatable switches on the remote devices irrespective of a location of the dimmer switch relative to locations of the remote devices in the lighting control circuit.

33. The wall mountable dimmer switch according to claim 32 wherein the control signals are AC control signals, the dimming circuit comprises a microprocessor and the receiving and processing means comprises circuitry defining a plurality of current paths, the control signals employing different ones of the current paths based upon which of the user actuatable switches on the remote devices has been actuated, the polarity of the AC source, and whether the control signal was generated by a remote device on the source side or a remote device on the load side of the dimmer switch.

34. A wall mountable dimmer switch for wiring to one of N switching locations of a lighting control system, where N is at least 3, the dimmer switch comprising an electronic dimming circuit adapted for connection to AC wiring interconnecting an AC source, a plurality N of switch locations and a load, the dimming circuit having means for receiving command information over said AC wiring from remote devices adapted to be disposed at the remaining ones of the N locations, the dimming circuit being responsive to actuation of a user actuatable switch on the dimmer switch, and to the command information received from a remote device, to adjust the level of power delivered to a load, irrespective of which one of the N locations wherein the dimmer switch is connected to the AC wiring.

35. The wall mountable dimmer switch according to claim 34 wherein the dimmer switch comprises at least a pair of hookup wires and the remote devices each comprise at least one hookup wire for connection to the AC wiring, the means for receiving command information enabling operation of the dimmer switch to control the load in response to commands from the remote devices irrespective of any reversal of connection of any of the hookup wires of the dimmer switch to the AC wiring.

36. The wall mountable dimmer switch according to claim 35 wherein the command information comprises AC control signals having AC source voltage magnitude, and wherein the dimmer switch and the remote devices each comprise another hookup wire coupled to said means for interconnection via the AC wiring, the remote devices communicating the control signals to the dimmer switch via the said another hookup wire and the AC wiring.

37. The wall mountable dimmer switch according to claim 34 wherein the means for receiving command information comprises location detection circuitry for providing an indication of a direction of origin of the command information relative to the location where the dimmer switch is connected to the AC wiring.

38. The wall mountable dimmer switch according to claim 37 wherein the dimming circuit comprises a microprocessor and the location detection circuitry comprises at least one optical isolator for generating the indication and providing the same to the microprocessor.

39. The wall mountable dimmer switch according to claim 34 wherein the dimming circuit comprises a triac having a pair of hookup wires operatively coupled thereto and defining hot and dimmed hot leads of the dimmer switch, the hot and dimmed hot leads being for connection to the AC wiring and carrying full load current in operation, the means enabling the dimmer switch to control the load in response to commands from the remote devices irrespective of any reversal of connection of hot and dimmed hot leads to the AC wiring.

40. The wall mountable dimmer switch according to claim 34 wherein the dimmer switch is adapted to be mounted in a NEMA standard 3" high by 1 31/32" wide wall box.

* * * * *